United States Patent [19]

Harker

[11] Patent Number: 4,625,743

[45] Date of Patent: Dec. 2, 1986

[54] CRUTCH

[76] Inventor: Garth L. Harker, 3720 Vista Dr., Nampa, Id. 83651

[21] Appl. No.: 764,392

[22] Filed: Aug. 12, 1985

[51] Int. Cl.[4] ..... A61H 3/02

[52] U.S. Cl. ..... 135/68; 135/72

[58] Field of Search ..... 135/68, 69, 72, 76, 135/65, 66, 73, 74, 75; D3/8

[56] References Cited

U.S. PATENT DOCUMENTS

| | | | |
|---|---|---|---|
| 1,277,009 | 8/1918 | Weldon | 135/68 |
| 1,383,156 | 6/1921 | Sherman | 135/69 |
| 2,778,370 | 1/1957 | Chamblee | 135/68 |
| 2,856,943 | 10/1958 | Sparlin | 135/68 |
| 3,269,399 | 8/1966 | Smith | 135/72 |
| 4,027,687 | 6/1977 | McGowan | 135/68 X |
| 4,385,697 | 5/1983 | Urban et al. | 135/68 X |

FOREIGN PATENT DOCUMENTS

| | | | |
|---|---|---|---|
| 119750 | 10/1918 | United Kingdom | 135/72 |
| 1104255 | 2/1968 | United Kingdom | 135/69 |

*Primary Examiner*—Robert A. Hafer
*Assistant Examiner*—Arnold W. Kramer
*Attorney, Agent, or Firm*—Paul F. Horton

[57] ABSTRACT

A crutch of the bifurcated type having a handgrip which is angularly offset relative to the armrest to accommodate the natural positioning of the hand and wrist. One or both support struts carrying the handgrips may be bent outwardly to carry the handgrip at a selected angle or brackets attachable to a conventional crutch may be used for the same purpose.

2 Claims, 7 Drawing Figures

CRUTCH

BACKGROUND OF THE INVENTION

1. Field of the Invention

This invention relates to improvements in crutches and more particularly to improvements in the handgrips of crutches having a bifurcated main frame.

2. Description of the Prior Art

Crutches in the prior art fall into two basic categories, namely the single pole type, as typified by U.S. Pat. No. 2,429,409 issued to G. G. Eidman and U.S. Pat. No. 2,690,188 issued to R. E. Goddard and the bifurcated type as typified by U.S. Pat. No. 1,303,721 issued to A. Plouffe and U.S. Pat. No. 1,459,333 issued to G. Hipwood.

The single pole type has the disadvantage of having a handgrip which is, of necessity, laterally offset from the longitudinal axis of the pole, making the crutch somewhat unstable and uncomfortable for the user.

By far the more common type of crutch is the type having a bifurcated main frame with a handgrip being in the same plane as the vertical struts of the bifurcated main frame. As an added comfort for some users, the handgrip has been offset outwardly from this plane by use of brackets as shown in the Plouffe and Hipwood patents—the handgrips still being parallel with the armrest.

Because of this parallel position of the handgrip, whether offset, as shown by Plouffe and Hipwood, or not offset, as is conventional, the handgrips of bifurcated crutches in the present art, are not positioned to the angle of rotation of the hand and wrist relative to the body of the person using the crutch—i.e., the natural position of the arm at rest. For this reason, it will be noted that the great majority of people using the bifurcated crutch usually engage the crutch handgrip, not with their entire palm, but rather with their thumb and index finger only. Also, because of the unnatural position of the handgrip, there is a tendency to hold the crutch at an exaggerated incline to the body to compensate for the discomfort.

SUMMARY OF THE INVENTION

The present invention overcomes these problems by providing a crutch of the bifurcated main frame type having a handgrip which is offset at an angle relative to the plane defined by the armrest and the ground engaging shaft so that the position of the handgrip approximates the natural position of the hand and arm at rest. A more complete description of the invention may be found in the claims appended hereto.

It is therefore a primary object of the present invention to provide a bifurcated crutch having a handgrip which is angularly offset from the vertical plane of the armrest to conform to the natural position of the arm and hand at rest.

More particularly, it is an object of the present invention to provide a bifurcated crutch having a handgrip which is comfortably gripped by the entire palm of the hand for control and stability.

It is also an object for the present invention to provide a bifurcated crutch having a handgrip which can be readily gripped by those having arthritis without an unnatural rotation of the hand.

Another object of the present invention is to provide a conventional bifurcated crutch having a bracket outwardly extending from the struts of the main frame for holding the handgrip at an angle relative to the vertical plane of the armrest.

Another object of the present invention is to provide a crutch where at least one of the struts of the bifurcated main frame is bent outwardly to support the handgrip at a selected offset angle relative to the vertical plane of the armrest.

Additional objects and advantages will become apparent at a more thorough and comprehensive understanding may be had from the following description taken in conjunction with the accompanying drawings forming a part of this specification.

DETAILED DESCRIPTION OF THE INVENTION

Figure 1:
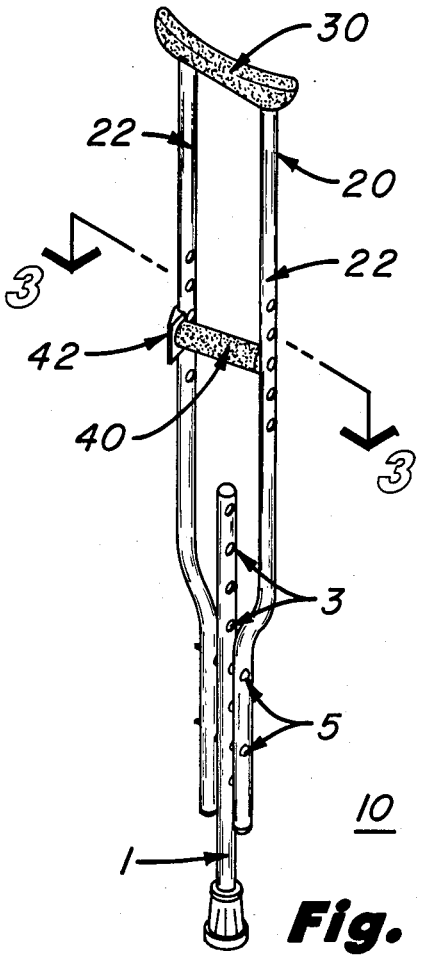
FIG. 1 is a perspective view of one embodiment of the improved crutch of the present invention.
Figure 2:
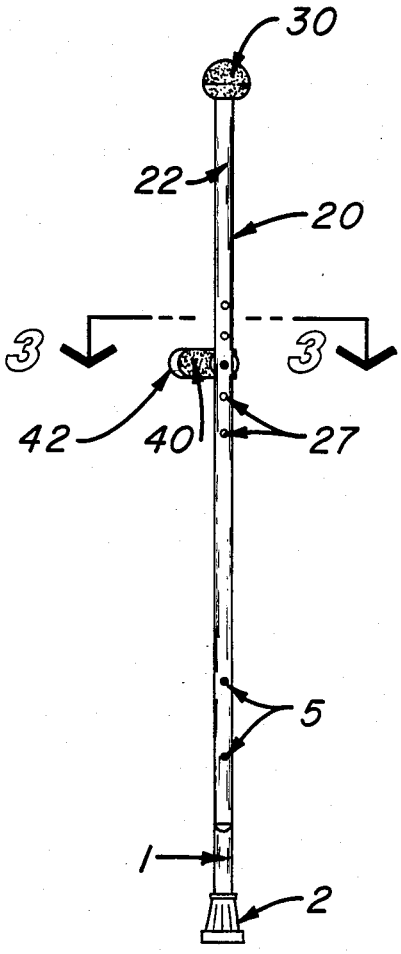
FIG. 2 is a side elevation of the crutch shown in FIG. 1.
Figure 3:
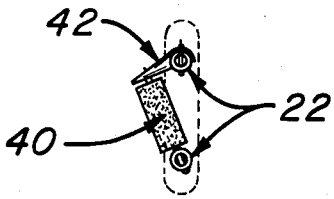
FIG. 3 is a sectional view taken along lines 3—3 of FIG. 2.

Referring now to FIGS. 1,2,3, and 7, a first embodiment to be preferred of an improved crutch 10, made according to the present invention is disclosed. Crutch 10 includes a ground engaging support shaft 1, a bifurcated main frame designated by the numeral 20, an armrest 30, and a handgrip 40.

Support shaft 1 is conventional in the art, preferably having a rubber foot and a plurality of vertically spaced openings 3 which may be moved into alignment with bolts 5 of frame 20 for vertically positioning of shaft 1 relative to the main frame to set the crutch at the proper height.

Bifurcated main frame 20, in the first embodiment, is also conventional in the art, having a pair of laterally spaced and vertically oriented struts 22. At their lowermost ends struts 22 converge to engage support shaft 1, being affixed to the support shaft by bolts 5. Both the main frame and the support shaft may be constructed of wood, aluminum or any other satisfactory material.

Mounted to the top ends of struts 22 is an armrest 30, the longitudinal axis of which is in a vertical plane with the longitudinal axes of struts 22 of bifurcated main frame 20 and support shaft 1; the armrest, main frame and support shaft therefore all being considered to be in the same vertical plane. The armrest includes the conventional padding composed of sponge rubber, or the like, for comfort.

Affixed to and outwardly extending from struts 22, from the user's perspective, is one or more brackets 42. In the present embodiment, a single bracket is used to support handgrip 40; one end of the handgrip engaging one of the struts directly and the end of the handgrip engaging the bracket. The bracket, and therefore the handgrip, is moveable vertically to be affixed by bolts receivable in apertures 27, or by other conventional means, to set the handgrip at a desired vertical placement relative to the struts.

Figure 7:
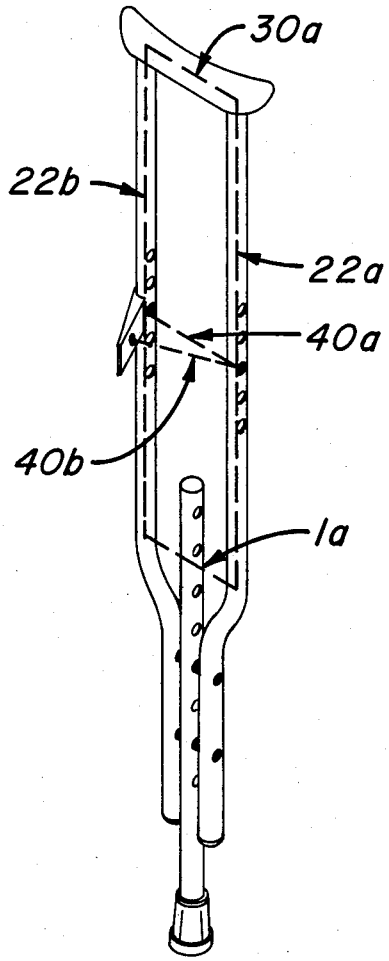
FIG. 7 is a schematic showing the vertical plane defined by the armrest and ground engaging shaft and the angle of the handgrip relative to the plane.

Critical to the invention is the handgrip 40 of the present invention. The handgrip is offset at an angle relative to the vertical plane defined by the armrest, support shaft, and struts. From the user's perspective, the handgrip is angled outwardly from the front strut to the rear strut at an angle approximating the angle of palm of the hand to the body in the free-hanging, resting position, normally an angle of 10 to 20 degrees. A single bracket of approximately $\frac{3}{4}''$ to $1\frac{1}{2}''$ in length is required for a crutch having a spacing $4\frac{3}{4}''$–5″ between struts. Referring to FIG. 7, a schematic of the vertical plane defined by the longitudinal axis 30*a* of the armrest, longitudinal axis 22*a* of the front strut, 22*b* of the rear strut, and 1*a* of the ground engaging support shaft is shown. Conventionally, the handgrip is mounted on or parallel to the vertical plane as shown by the handgrip axis 40*a*. In the present invention the handgrip is offset at a selected angle theta to this plane, having a longitudinal axis designated as 40*b*.

Figure 4:
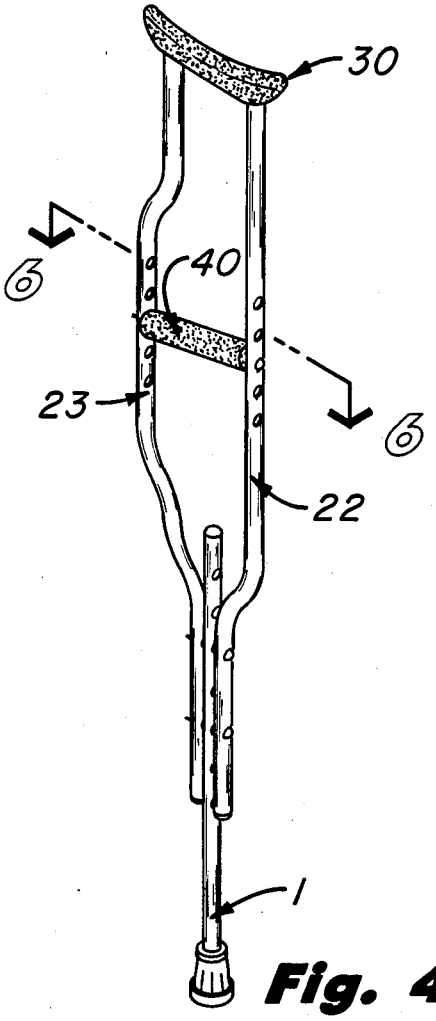
FIG. 4 is perspective view of a second embodiment of the present invention.
Figure 5:
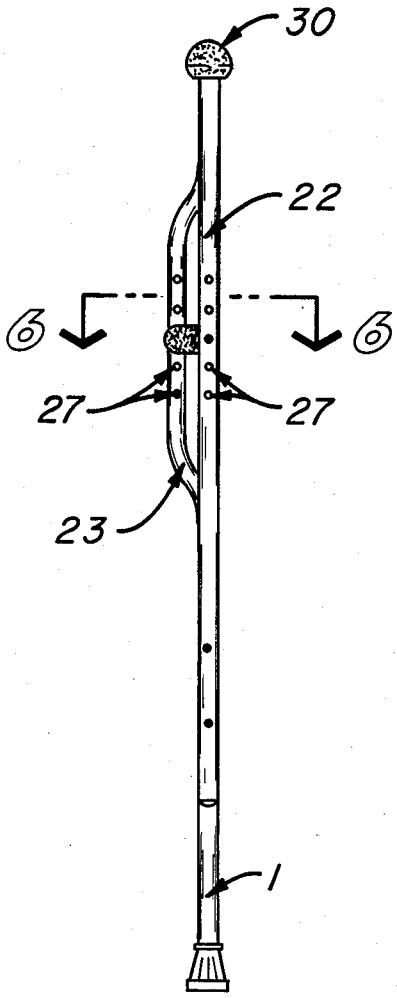
FIG. 5 is a side elevation of the crutch shown in FIG. 4.
Figure 6:
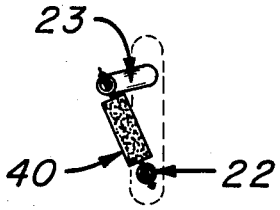
FIG. 6 is a sectional view taken along lines 6—6 of FIG. 5.

Referring now to FIGS. 4, 5, and 6 taken in conjunction with FIG. 7, a second preferred embodiment of the present invention is shown. The crutch of the second embodiment differs from the crutch of the first embodiment in the elimination of support brackets and the inclusion of at least one strut of the bifurcated main frame being bent from the vertical plane, shown in FIG. 7, defined by the armrest and the ground support. Handgrip 40 is directly connected between the struts. One strut, designated by the numeral 23 is bent outwardly relative to the user of the crutch. Strut 23 is the rear strut and strut 22 is the front strut relative to the user. The angle of divergence from the vertical plane is designated by the angle theta, shown in FIG. 7. Strut 23 may be provided with a plurality of vertically spaced apertures 27 which are positioned horizontally from like apertures in strut 22 for horizontal placement of the handgrip.

For use of either embodiment, the user grasps the handgrip with the full palm with the hand and wrist at an outwardly diverging angle relative to the user from front to back. Because of the positioning of the handgrip at such an angle, the user tends to hold the crutch in a more vertical position than conventional crutches, giving the user superior control and preventing outwardly slippage of the crutch.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are to be therefore considered in all respects as illustrative and not restrictive, the scope of the invention being indicated by the appended claims rather than by the foregoing description, and all changes which come within the meaning and range of equivalency of the claims are therefore to be embraced therein.

I claim:

1. A crutch comprising:

a ground engaging support shaft;

a bifurcated main frame carried by said support shaft, said main frame including first and second vertically extending struts;

an armrest carried by and affixed to the uppermost terminal end of said struts; the longitudinal axis of said first strut being in a plane with the longitudinal axis of said armrest and said second strut defining two end portions and a mid-portion, the longitudinal axis of said mid-portion being offset and parallel to the plane of said first strut and armrest; and a substantially horizontal handgrip, said handgrip affixed to said first strut and the mid-portion of said second strut at an angle relative to the plane defined by said first strut and said armrest.

2. The apparatus as described in claim 1 wherein said first strut and said second strut are provided with a plurality of vertically spaced apertures for affixing said handgrip thereto at a selected height.

* * * * *